US011555589B1

(12) United States Patent
Geiger et al.

(10) Patent No.: US 11,555,589 B1
(45) Date of Patent: Jan. 17, 2023

(54) STRUCTURAL LIGHT FIXTURE FOR A CLEAN ROOM CEILING, CLEAN ROOM CEILING SYSTEM AND METHODS

(71) Applicant: AES CLEAN TECHNOLOGY, INC., Montgomeryville, PA (US)

(72) Inventors: Robert J. Geiger, North Wales, PA (US); Jason Peers, Chalfont, PA (US); Andrew J. Kugler, Jenkintown, PA (US)

(73) Assignee: AES Clean Technology, Inc., Montgomeryville, PA (US)

( * ) Notice: Subject to any disclaimer, the term of this patent is extended or adjusted under 35 U.S.C. 154(b) by 0 days.

(21) Appl. No.: 17/693,965

(22) Filed: Mar. 14, 2022

(51) Int. Cl.
*F21S 8/04* (2006.01)
*F21V 21/008* (2006.01)
*F21V 31/00* (2006.01)

(52) U.S. Cl.
CPC ..... *F21S 8/043* (2013.01); *F21V 21/008* (2013.01); *F21V 31/005* (2013.01)

(58) Field of Classification Search
CPC ..... F21V 31/005; F21S 8/043
See application file for complete search history.

(56) References Cited

U.S. PATENT DOCUMENTS

| | | | | |
|---|---|---|---|---|
| 5,613,759 | A * | 3/1997 | Ludwig | E04B 9/02 55/385.2 |
| 5,902,035 | A * | 5/1999 | Mui | F21V 15/01 362/147 |
| 10,113,724 | B2 | 10/2018 | Satterfield | |
| 10,151,462 | B1 | 12/2018 | Satterfield | |
| 10,465,385 | B2 | 11/2019 | Satterfield | |
| 10,612,236 | B1 | 4/2020 | Satterfield | |
| 2015/0338084 | A1 | 11/2015 | Ryder | |
| 2019/0170341 | A1* | 6/2019 | Lax | F21V 29/763 |
| 2020/0393610 | A1* | 12/2020 | Miles | F21V 3/049 |

* cited by examiner

*Primary Examiner* — Leah Simone Macchiarolo
(74) *Attorney, Agent, or Firm* — Robert J. Yarbrough; Lipton, Weinberger & Husick

(57) ABSTRACT

A structural light fixture for the ceiling of clean room, such as a clean room for pharmaceutical or electronic research or production, includes an outer U-shaped beam and an inner U-shaped beam. The inner U-shaped beam nests within the outer U-shaped beam. The inner and outer U-shaped beams are mutually reinforcing so that the combination of the two U-shaped beams is stronger and stiffer than either U-shaped beam alone. The top side of the outer U-shaped beam is exposed to the outside of the clean room and includes no perforations so that the outer U-shaped beam is a barrier to gas, particulates, microorganisms or disinfectants that otherwise would pass through the clean room ceiling. The removable inner U-shaped beam includes a lamp and power supply, allowing maintenance of the structural light fixture from the interior of the clean room without interrupting the barrier to contamination created by the structural light fixture.

21 Claims, 11 Drawing Sheets

STRUCTURAL LIGHT FIXTURE FOR A CLEAN ROOM CEILING, CLEAN ROOM CEILING SYSTEM AND METHODS

I. BACKGROUND OF THE INVENTION

A. Field of the Invention

The Invention relates to clean rooms, such as clean rooms used to control contamination in the pharmaceutical and electronics industries. The Invention is a structural light fixture for use in a ceiling of a clean room and is a ceiling system that includes the structural light fixture. The Invention also is a method of constructing a ceiling using the structural light fixture and is a method of maintaining the light fixture in the clean room ceiling. The structural light fixture of the invention strengthens the ceiling and maintains security from contamination within the clean room while allowing servicing of the light fixture from within the clean room.

B. Statement of the Related Art

Clean rooms are used to control the environment and prevent contamination of product, equipment, materials and processes in the pharmaceutical, biotechnology, life sciences and technology industries. A clean room may take the form of a building-within-a-building, with a clean room envelope within a larger building envelope. The larger building protects the clean room from the elements, contains mechanical systems serving the clean room and may provide structural support to the clean room. The clean room provides a discrete space in which the operator can separately control the temperature, humidity, cleanliness and air pressure.

The ceiling of a clean room may support more than the weight of the ceiling. For example, the ceiling may support the weight of equipment, such as HVAC, electrical, gas, or water utilities or other equipment serving the clean room and the weight of installers or users walking, crouching or crawling on the ceiling to install or maintain the equipment. Clean rooms may utilize composite construction, with walls and ceiling composed of opposing steel panels bonded to an aluminum honeycomb core. For reduced weight and cost, the composite panels are constructed to be as thin as possible, consistent with the structural requirements of the ceiling and walls.

II. BRIEF DESCRIPTION OF THE INVENTION

The Invention is a light fixture that also serves the purpose of a structural beam to support adjacent ceiling components of a clean room ceiling, all while segregating the interior of the clean room from the exterior. The structural light fixture allows servicing of a lamp and power supply from the interior of the clean room without interfering with the barrier created by the structural light fixture to the movement of liquid, gas, contaminants or disinfectants through the clean room ceiling.

The structural light fixture includes two nesting, inverted U-shaped beams; namely, an outer U-shaped beam and an inner U-shaped beam. Each of the inner and outer U-shaped beams is unitary and composed of a single extrusion, preferably composed of aluminum. The outer U-shaped beam is secured to the surrounding components of the ceiling, such as composite panels, in a mutually supporting relationship. The top and sides of the outer U-shaped beam are closed and do not define openings communicating through the structural light fixture. The unperforated outer U-shaped beam, combined with the fluid-tight joints between the outer U-shaped beam and the adjacent components of the ceiling, prevent air or other gas from moving between the atmosphere inside the clean room and the atmosphere outside the clean room by leaking through or around the structural light fixture. The closed and unperforated outer U-shaped beam also prevents movement of liquids, particulates, disinfectants, microorganisms or other biological material across the structural light fixture between the interior and exterior of the clean room.

The outer and inner U-shaped beams each defines an interior volume and an open side. The inner U-shaped beam nests within the outer U-shaped beam so that the inner beam interior volume is largely contained within the outer beam interior volume. The open sides of both the inner and outer U-shaped beams are oriented toward the interior of the clean room when the structural light fixture is installed in the clean room ceiling. The inner U-shaped beam is selectably attached to the outer U-shaped beam and reinforces the outer U-shaped beam. The strength and stiffness of the combination of the inner and outer U-shaped beams is greater than the strength and stiffness of either the outer U-shaped beam or inner U-shaped beam alone.

The inner U-shaped beam supports lamps, which may be LED lamps, that are the source of light. The lamps may use any other technology to generate or distribute light, such as light-emitting capacitors, light pipes, or fluorescent or incandescent lamps. The inner U-shaped beam also supports the power supply for the LED lamps and a lens covering the LED lamps. The power supply may include a back-up battery to illuminate the lamps in the event of a power failure.

When the structural light fixture is installed in a clean room ceiling, the combination of the inner and outer U-shaped beams reinforces adjacent ceiling panels or other ceiling components and increases the strength and stiffness of the ceiling compared to a ceiling that does not include the structural light fixture having inner and outer U-shaped beams. The combination of the inner and outer U-shaped beams is capable of sharing a load applied to an adjacent ceiling components and is capable of transferring a load to the adjacent ceiling component.

A lamp is located within the inner U-shaped beam interior volume and is configured to project light through the open sides of the inner U-shaped beam and outer U-shaped beam into the interior of the clean room when the structural light fixture is installed in the clean room ceiling. A lens covers the lamp and may be resiliently retained within the inner U-shaped beam. The inner U-shaped beam is releasably retained by the outer U-shaped beam by fasteners such as screws or clamps. The fasteners may be disposed under the lens and accessed when the lens is removed. Removing or releasing the fasteners or clamps allows a user to remove the inner U-shaped beam from the outer U-shaped beam when the user is within the clean room. Removing the inner U-shaped beam allows the user to service the power supply and the lamp without jeopardizing the liquid- and gas-tight seal between the interior and the exterior of the clean room.

The ceiling system of the Invention includes the structural light fixture, one or more other ceiling components that selectably mate with structural light fixture, flush beams to support the structural light fixture and the other ceiling components, and cables or rods to support the flush beams. The other ceiling components to which the structural light fixture may be attached include ceiling panels as described above, other structural light fixtures, utility races, other structural beams, or any other ceiling component.

To support the structural light fixture and other ceiling components, opposing flush beams extend between the tops of opposing clean room walls or are disposed at the top of opposing clean room walls. The top of the flush beam defines a channel. The channel can receive one or more cable or rod fasteners for attachment to cables or rods. The cables or rods attach the cable or rod fasteners to the building structure and can support the flush beam intermediate to the opposing walls. Each flush beam defines a shelf at the bottom of the flush beam extending the length of the flush beam. Hook ends are disposed at opposing ends of the ceiling components, such as ceiling panels and the structural light fixture, and engage the shelves of opposing flush beams. Each flush beam shelf has an upright ridge that extends the length of the flush beam shelf. The ridge of the flush beam shelf engages a mating groove on the hook end. The ridge and mating groove align the flush beam and ceiling component.

In the system of the Invention, the structural light fixture and other ceiling components are joined by slots and splines. The structural light fixture defines a longitudinal slot on either side of the structural light fixture and extending the length of the structural light fixture. The longitudinal slots of the structural light fixture correspond in location to component slots defined by other ceiling components on either side of the structural light fixture, such as ceiling panels, utility raceways, other structural beams, and other structural light fixtures. A connecting spline is inserted into adjoining longitudinal slots and component slots during installation, sealing the junction between the adjacent structural light fixture and other ceiling components. The spline may be composed of a metal, such as aluminum, or a polymer, and prevents or reduces liquid or gas penetration between adjacent ceiling components.

The splines also serves to transmit a load applied to one ceiling component to adjacent components, such as other structural light fixture or ceiling panels. For example, a load applied to a ceiling panel may be transmitted to an adjacent structural light fixture by the spline. The splines therefore structurally join the structural light fixture to other ceiling components in an integrated whole.

As an alternative to the ceiling system described above, the system may dispense with flush beams. Instead, each of the ceiling components, including the ceiling panels, utility raceways, structural beams, and other structural light fixtures define slots in each of its four sides. Each slot is disposed opposite a slot in an adjoining ceiling component. Each pair of adjoining components is connected by a spline mating with the adjoining slots. Because of the lack of flush beams, the ceiling components are suspended directly from the building structure, as by rod or cables attached to plates bolted to the ceiling components. For this alternative system, the structural light fixture and ceiling components described above dispense with the hook ends. The structural light fixture is attached to adjoining ceiling components by splines in the slots on each of the opposing ends and by splines in longitudinal slots on opposing sides of the structural light fixture. In all other respects, the structural light fixture of the alternative ceiling is the same as the structural light fixture of the ceiling utilizing flush beams and as described above.

The bottom side of the structural light fixture may be coated with PVC and may be solvent-welded to adjoining ceiling components to seal the junction between the structural light fixture and other ceiling components, as against the passage of liquid, biological or other contaminants and against the passage of disinfectants or gas. Alternatively, the bottom side of the structural light fixture may be composed of, for example, powder-coated aluminum and the junction with other ceiling components may be sealed with a suitable sealant, such as a silicone caulk.

The method of installation of the Invention is a method of installing a clean room ceiling that includes the structural light fixture of the Invention. To install the clean room ceiling, an installer will install support rods or cable to the building structure and will install opposing flush beams that are suspended by the support rods or cables. The installer will obtain the structural light fixture as described above having nesting inner and outer U-shaped beams and hook ends. The installer will place the hook ends in engagement with the opposing flush beams. The installer will place splines in longitudinal slots of the structural light fixture and in the component slots of adjacent ceiling components. The user will seal the joints between the structural light fixture and adjacent ceiling components, either by solvent welding or by apply a sealant.

The method of maintaining the structural light fixture is applied after the structural light fixture is installed in the clean room ceiling. While located in the interior of the clean room, the user may remove the lens from the inner U-shaped beam and may repair or replace the lamp. The user may then remove or otherwise disconnect fasteners or clamps connecting the inner U-shaped beam to the outer U-shaped beam. The user may then remove the inner U-shaped beam and repair or replace the power supply and/or battery backup. Assembly of the structural light fixture is the reverse of disassembly.

Servicing of the structural light fixture from inside the clean room provides advantages to the user and to the clean room designer. First, access to the sealed structural light fixture from inside the clean room avoids any issues with movement of gas, liquid, or contaminants through the structural light fixture. Second, access to the top of the clean room ceiling may be limited by the physical dimensions of the space above the clean room ceiling and by HVAC, gas, water, electrical or other utilities or equipment installed above the clean room ceiling. Servicing the structural light fixture from inside the clean room avoids any issues with physical access to the top of the clean room ceiling. Third, servicing of the structural light fixture from inside the clean room also provides the clean room designer with greater flexibility, since the designer can select the location of HVAC, gas, water, and electrical or other utilities or equipment above the clean room ceiling without regard to providing access to the structural light fixture from above.

III. BRIEF DESCRIPTION OF THE DRAWINGS

IV. DESCRIPTION OF AN EMBODIMENT

Figure 1:
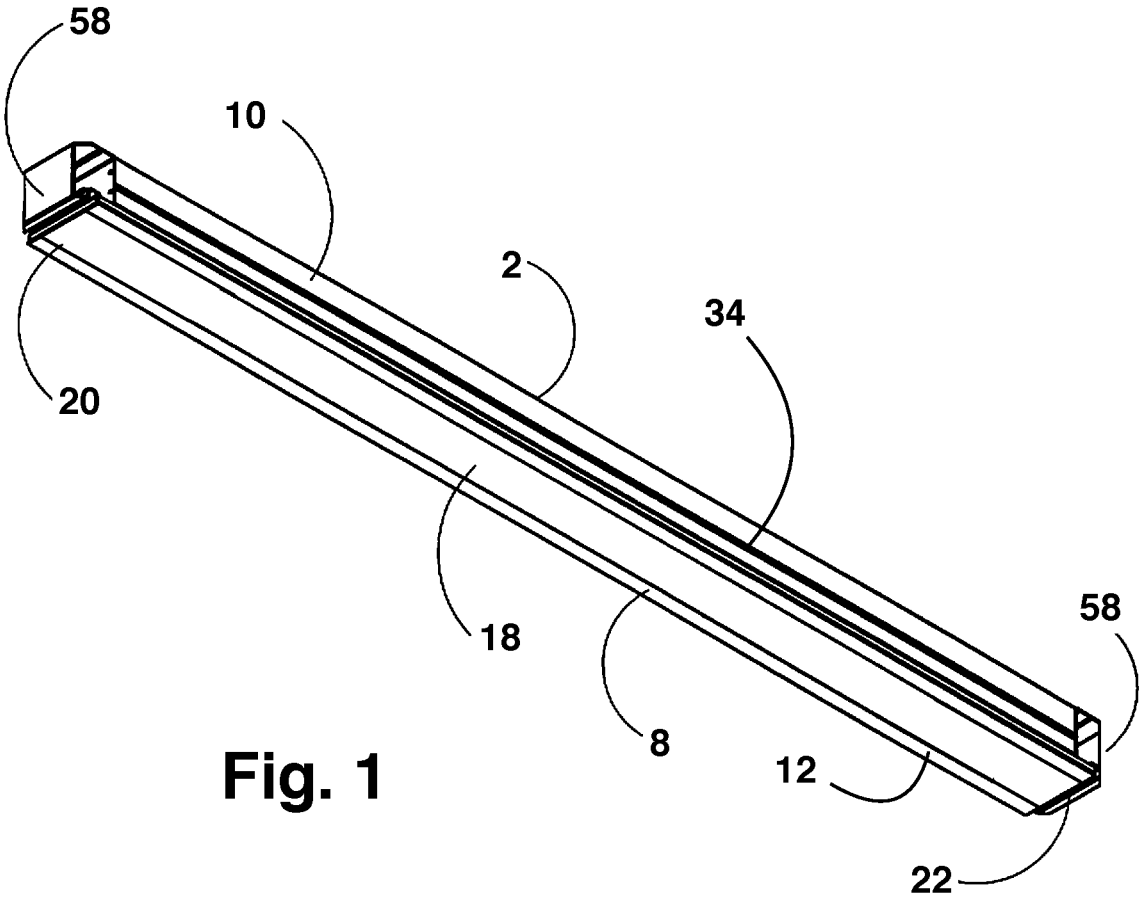
FIG. 1 is a perspective view of the underside of the structural light fixture.

The invention is a structural light fixture 2 that is a component of a ceiling 4 of a clean room 4. FIG. 1 is a perspective view of the underside 8 of the structural light fixture 2. An outer U-shaped beam 10 extends the length of the structural light fixture 2. A lamp 14 (FIG. 2), such as an LED lamp 14, is disposed within the structural light fixture 2 and is configured to project light through a lens 18 to the interior of the clean room. The lens 18 extends the length of the structural light fixture 2. The structural light fixture 2 has a first end 20 and an opposing second end 22. Hook ends 58 are disposed at the first end 20 and the second end 22 of the structural light fixture 2.

Figure 2:
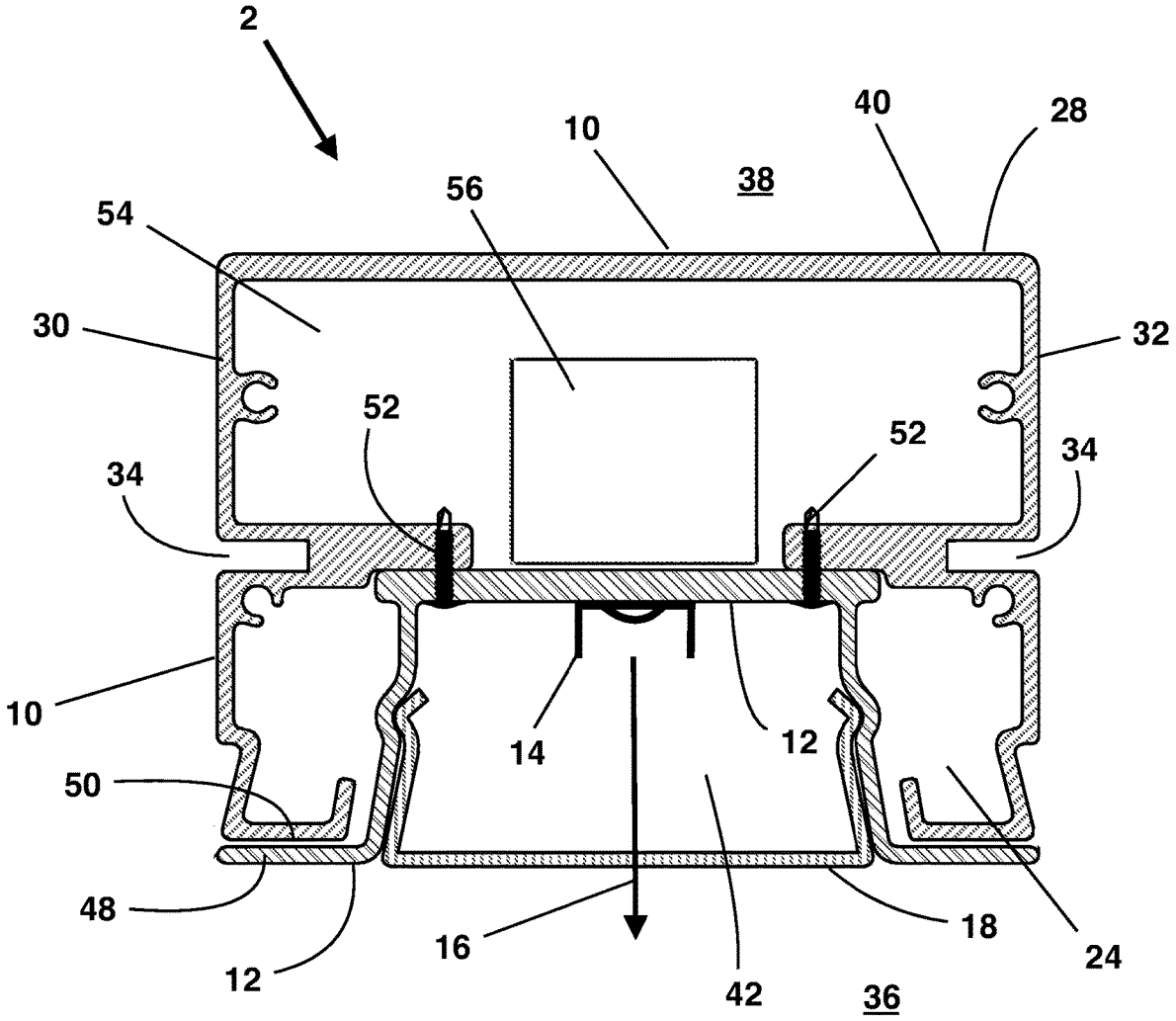
FIG. 2 is a section view of the structural light fixture.
Figure 3:
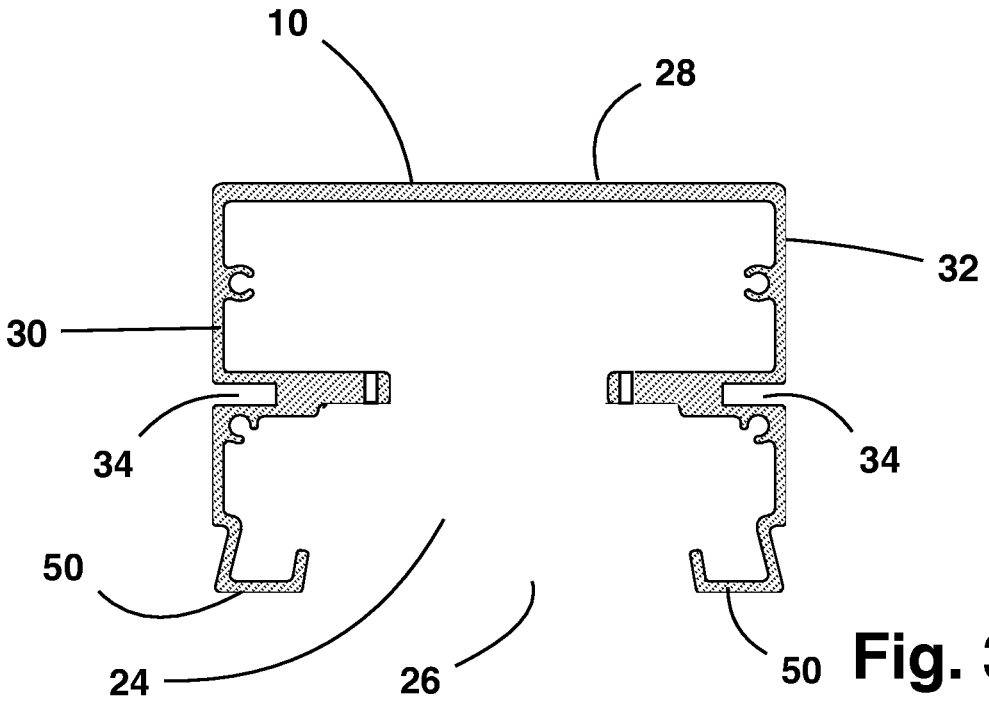
FIG. 3 is a section view of the outer U-shaped beam.
Figure 4:
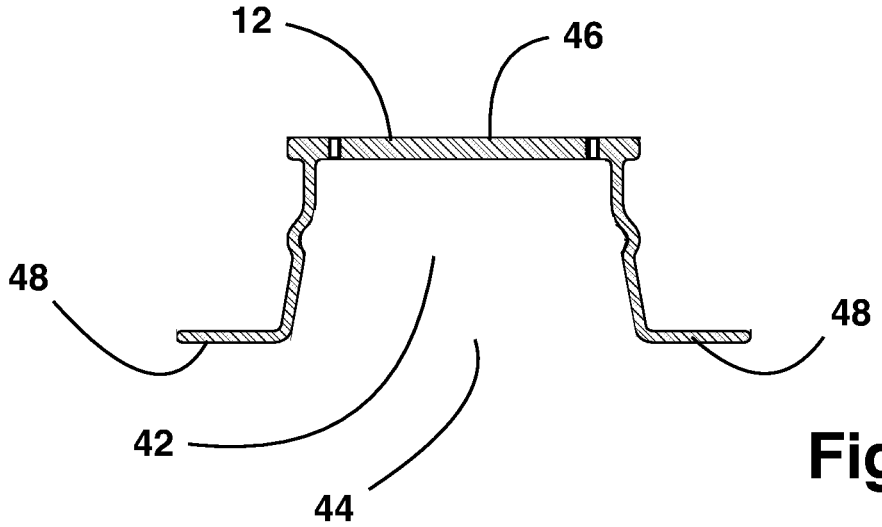
FIG. 4 is a section view of the inner U-shaped beam.
Figure 5:
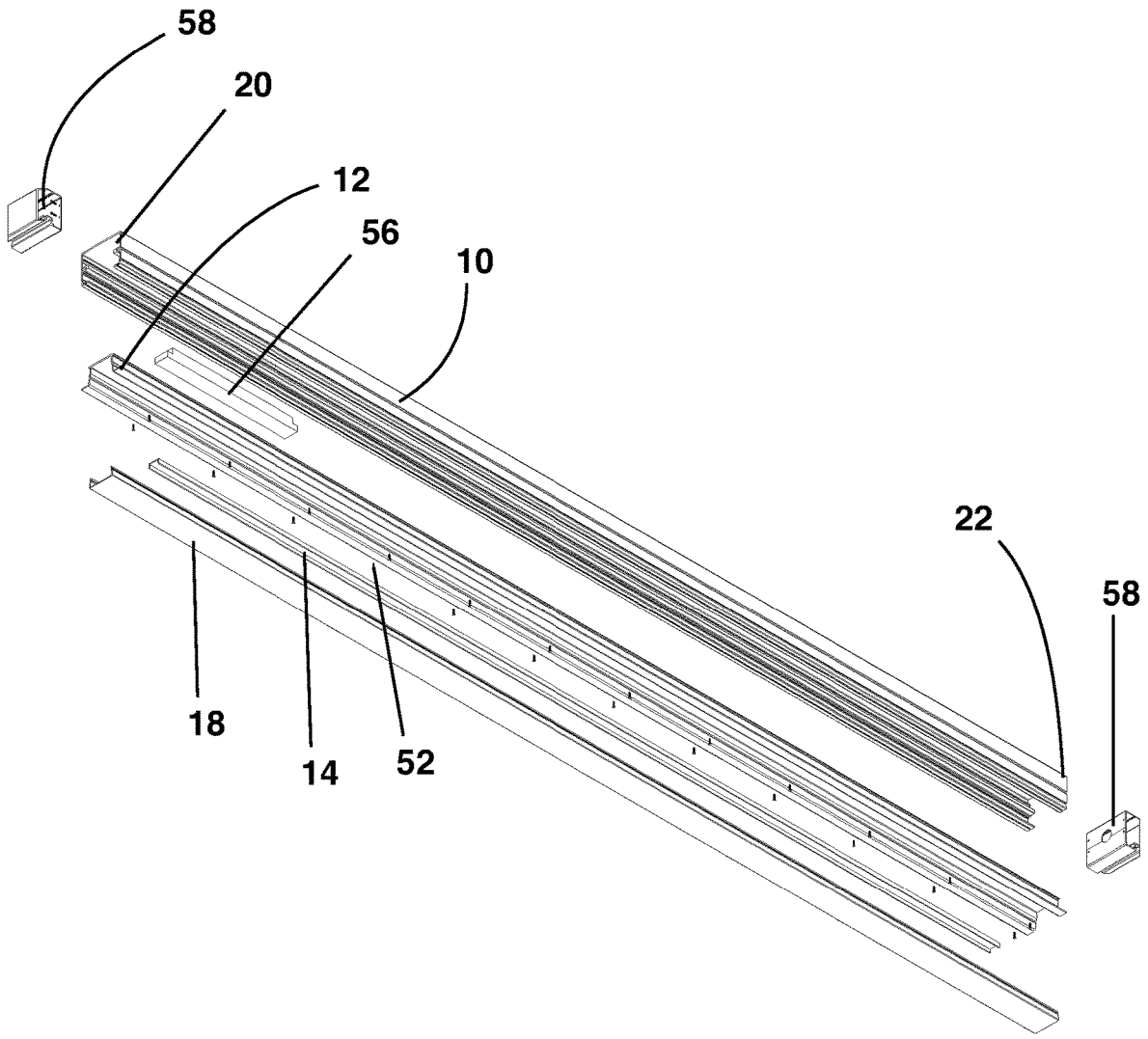
FIG. 5 is an exploded view of the structural light fixture.
Figure 6:
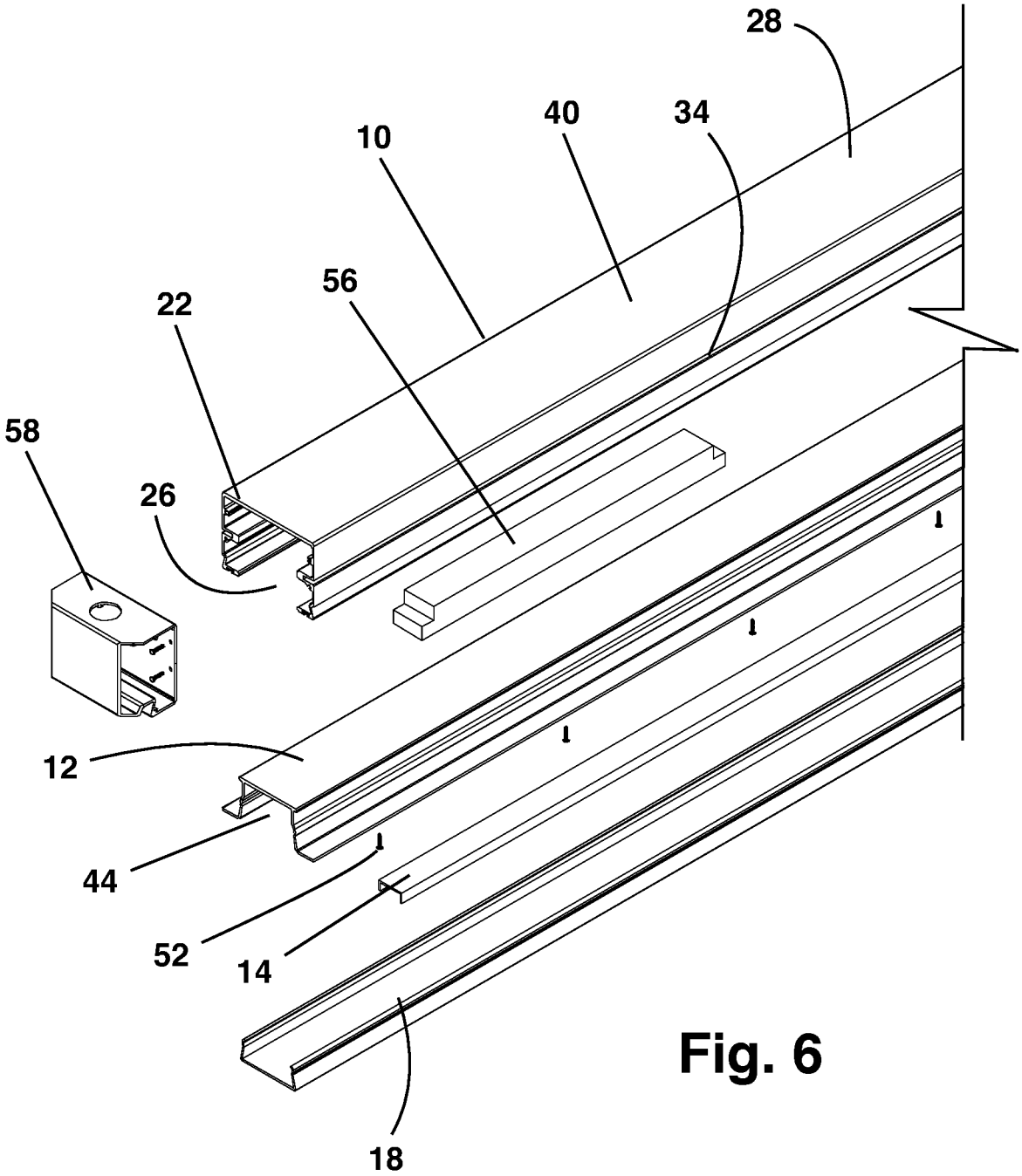
FIG. 6 is a detail exploded view of the structural light fixture from above.
Figure 7:
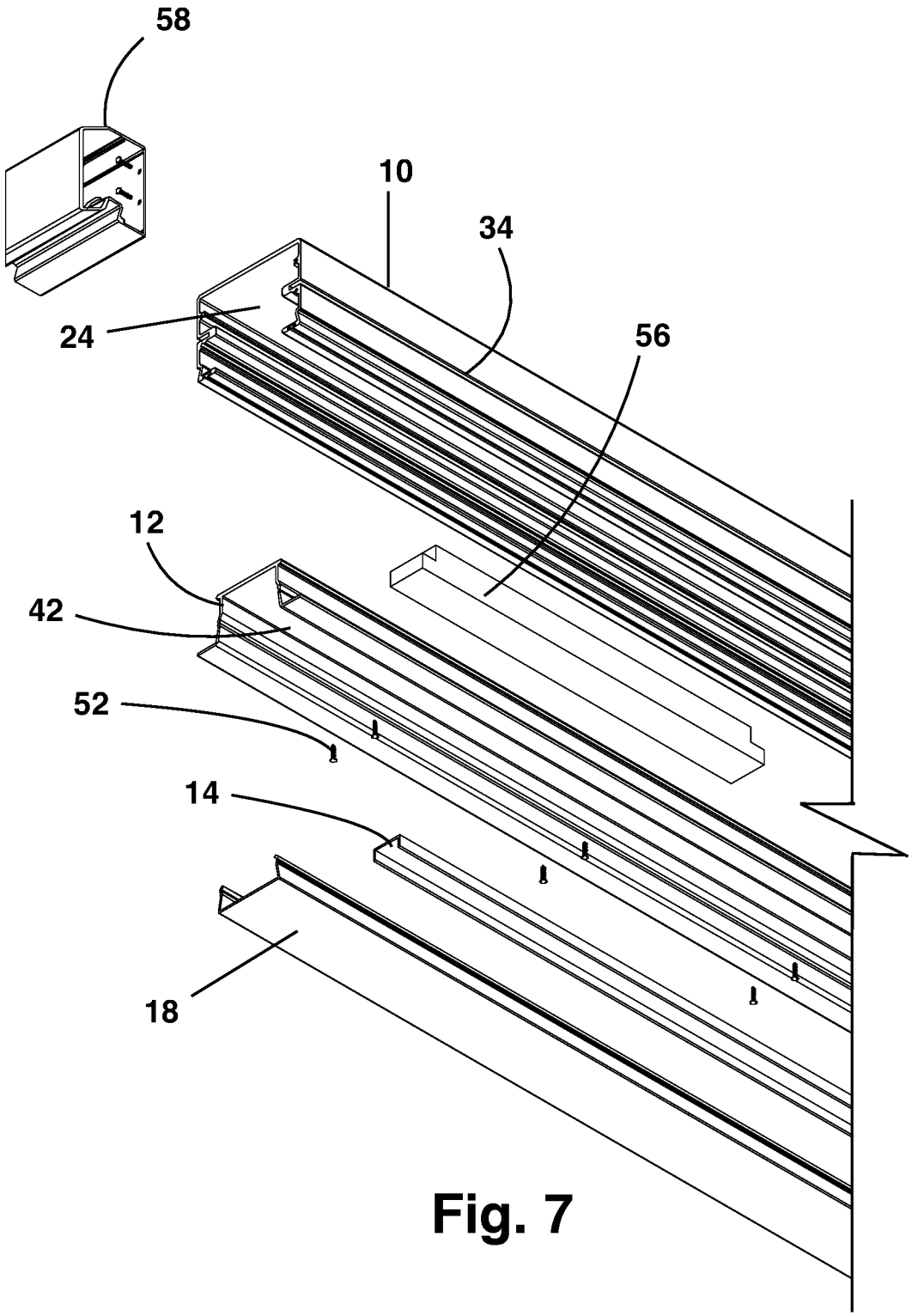
FIG. 7 is a detail exploded view of the structural light fixture from below.

FIGS. 2 through 7 show the construction of the structural light fixture 2, including the nesting outer U-shaped beam 10 and the inner U-shaped beam 12. FIG. 2 is a cross section view of the assembled structural light fixture 2. FIG. 3 is a cross section of the outer U-shaped beam 10. FIG. 4 is a cross section of the inner U-shaped beam 12. FIGS. 5, 6 and 7 are exploded views of the structural light fixture 2. FIG. 5 is an exploded view from the underside of the structural light fixture 2. FIG. 7 is a detail of FIG. 5. FIG. 6 is a detail exploded view from above the structural light fixture 2.

From FIGS. 2 and 3, the outer U-shaped beam 10 defines an outer beam interior volume 24, an outer U-shaped beam open side 26 and an opposing outer beam top side 28. The outer beam 10 also has opposing outer beam left and right sides 30, 32. The opposing outer beam left and right sides 30, 32 define longitudinal slots 34 extending the length of the structural light fixture 2. The longitudinal slots 34 correspond to component slots 68 in adjacent ceiling components 60 (see FIG. 8) and are configured to receive splines 70 to attach the structural light fixture 2 to the adjacent ceiling components 60 and to transfer structural loads between the structural light fixture 2 and the adjacent ceiling components 60. The combination of the longitudinal slots 34 and splines 70 also reduces the movement of air, gas, contaminants, disinfectants, microorganisms and other biological material between the clean room interior 36 and the clean room exterior 38 when the structural light fixture 2 is installed in the clean room ceiling.

From FIGS. 2, 3 and 4, the outer beam open side 26 is oriented toward the clean room interior 36 when the structural light fixture 2 is installed as part of the clean room ceiling 4. The left and right sides 30, 32 and outer beam top side 28 do not have openings communicating through the left or right sides 30, 32 or through the outer beam top side 28. The structural light fixture 2 is electrically powered and a cable will penetrate either the top side 28 of the outer beam 10 or the hook end 58. The cable is sealed to the outer beam 10 by a grommet to prevent the passage of air or other gases, liquid, contaminants, microorganisms or other biological material through the structural light fixture 2. The outer beam top side 28 is oriented away from the clean room interior 36 and forms part of the top 40 of the clean room ceiling 4 when structural light fixture 2 is installed in the clean room ceiling 4. The absence of openings through the left, right and closed sides 30, 32, 28 of the outer U-shaped beam 10 prevents movement of liquid, air, gas, contaminants, disinfectants, microorganisms or other biological material through the structural light fixture 2 when the structural light fixture 2 is installed in the clean room ceiling 4.

The inner U-shaped beam 12 is shown in cross section in FIG. 4 and is shown attached to the outer U-shaped beam 10 by FIG. 2. The inner U-shaped beam 12 defines an inner beam interior volume 42, an inner beam open side 44, an inner beam top side 46 and inner beam flanges 48. The U-shaped inner beam 12 nests within the U-shaped outer beam 10 10, as shown by FIG. 2, with the inner beam open side 44 oriented toward the clean room interior 36 when the structural light fixture 2 is installed in the clean room ceiling 4. The inner beam interior volume 42 is disposed substantially within the outer beam interior volume 24. The flanges 48 engage corresponding outer beam surfaces 50. The inner U-shaped beam 12 and outer U-shaped beam 10 are attached by fasteners 52, shown by FIG. 2.

As shown by FIG. 2, a lamp 14, such as an LED lamp 14, is located within the inner beam interior volume 42 and is configured to project light 16 through a lens 18 and through the inner beam open side 44 and outer beam open side 26 and into the clean room interior 36. The lens 18 is resiliently connected to the inner U-shaped beam 12.

From FIG. 2, the inner and outer U-shaped beams 12, 10 in combination define a power supply volume 54. A power supply 56 is housed within the power supply volume 54 and energizes lamp 14.

From FIGS. 5-7, the structural light fixture 2 is elongated and defines a length between the first end 20 and the second end 22. Hook ends 58 are attached to the opposing ends 20, 22 of the outer U-shaped beam 10 and are configured to support the structural light fixture 2, as described below. FIGS. 5-7 also illustrate the nesting arrangement of the outer U-shaped beam 10 and inner U-shaped beam 12 shown by FIG. 2. FIGS. 5-7 also illustrate that the top and sides 28, 30, 32 of the outer U-shaped beam 10 are not perforated.

Figure 8:
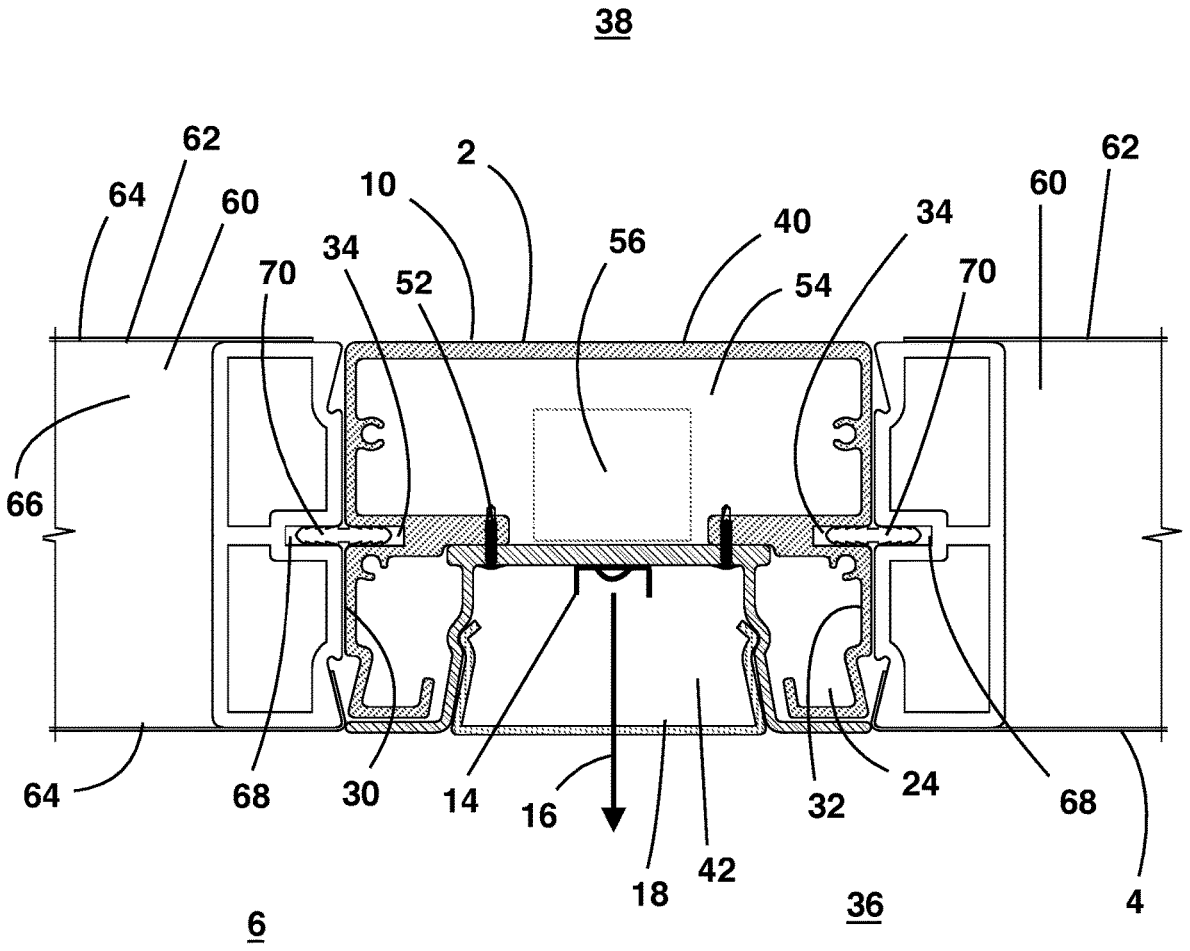
FIG. 8 is a section view of the structural light fixture installed in a clean room ceiling.

FIGS. 8 through 11 show the system of the Invention and the relationship between the structural light fixture 2 and the other components 60 of the clean room ceiling 4. As shown by the sectional view of FIG. 8, the structural light fixture 2 may be combined in the ceiling 4 with another ceiling component 60. The structural light fixture 2 and the other components 60 of the ceiling 4 are modular, allowing a designer to design the ceiling 4 by selecting among a multiplicity of possible combinations and orientations of the modular components 60. All possible arrangements of the modular components 60 and of the structural light fixtures 2 are contemplated by the Invention. The "another ceiling component" 60 may be another structural light fixture 2, a composite panel 62, a utility raceway, a structural beam, or any other modular component 60 of the clean room ceiling 4. In the example of FIG. 8, the structural light fixture 2 is combined with two composite panels 62 adjacent to the left and right sides 30, 32 of the structural light fixture 2.

From FIG. 8, each composite panel 62 features opposing skins 64 and a core 66. The core 66 is bonded to the skins 64. The skins 64 may be composed of any suitable material having suitable strength and toughness, such as sheet steel. The core 66 may be composed of any suitable material that imparts sufficient stiffness in flexion to the composite panel 62, such as crenelated aluminum.

FIG. 8 also illustrates how a structural load applied to the ceiling 4 is shared among the structural light fixture 2 and the other ceiling components 60. Each structural light fixture 2 features longitudinal slots 34 on the opposing left and right sides 30, 32. Each other ceiling component 60 also features a matching component slot 68 that extends the length of the other ceiling component 60 and that corresponds in location to the longitudinal slot 34 when the other component 60 and the structural light fixture 2 are in mating engagement. A spline 70 is disposed in both the longitudinal slot 34 and the component slot 68 and may extend the length of the longitudinal slot 34 and the component slot 68. The spline 70 joins the structural light fixture 2 to the other component 60 and provides an additional seal between the structural light fixture 2 and the other component 60. The spline 70 joins the structural light fixture 2 and other component 60 structurally, so that a load applied to the other ceiling component 60 is transferred by the spline 70 to the structural light fixture 2. In a similar manner, a load applied to the structural light fixture 2 is transferred by the spline 70 to the adjacent other ceiling component 60. The spline 70 may be composed of a polymer or of any other suitable material that will both seal the connection between the two components 2, 60 and that will provide a structural connection between the two components 2, 60.

The load sharing provided by the splines 70 between the structural light fixture 2 and the other ceiling components 60 makes the ceiling 4 stiffer and stronger than it would otherwise be, allowing otherwise identical components 60 to span longer distances than would otherwise be the case, or allowing the other ceiling components 60 to be constructed from lighter, thinner, weaker and hence less expensive materials than would otherwise be the case.

The junction between the structural light fixture 2 and the other ceiling components 60 may be sealed. The junction can be sealed by solvent-welding a polyvinyl chloride (PVC) coating on each of the ceiling components 2, 60 to the adjoining ceiling component 2, 60 by dissolving the adjoining PVC coatings with an organic solvent and allowing the solvent to evaporate, joining the two PVC coatings. Alternatively, the adjoining ceiling components 2, 60 may be sealed by use of a sealant, such as silicone caulk, applied to the junction.

Figure 9:
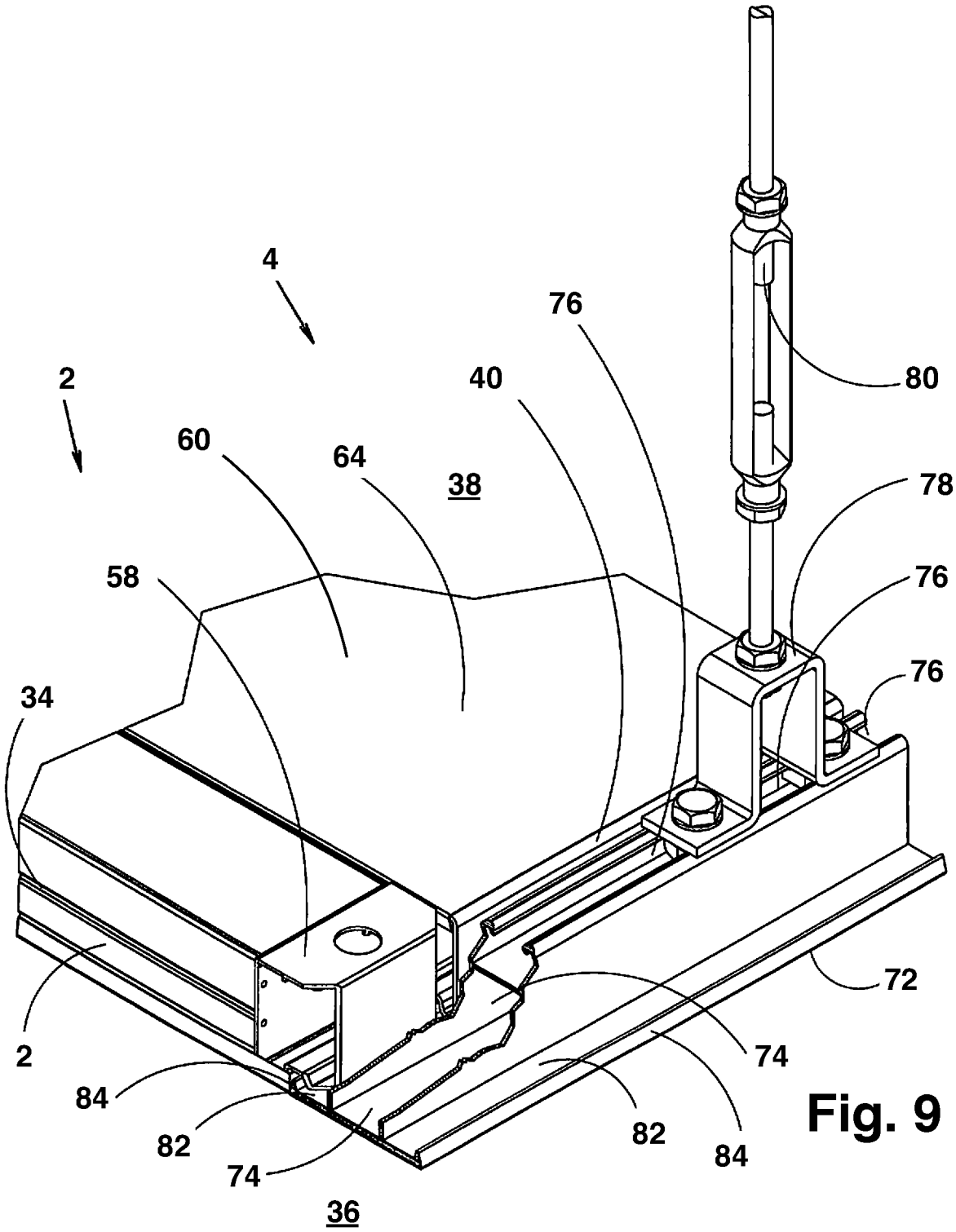
FIG. 9 is a detail perspective view of the system of the Invention.
Figure 10:
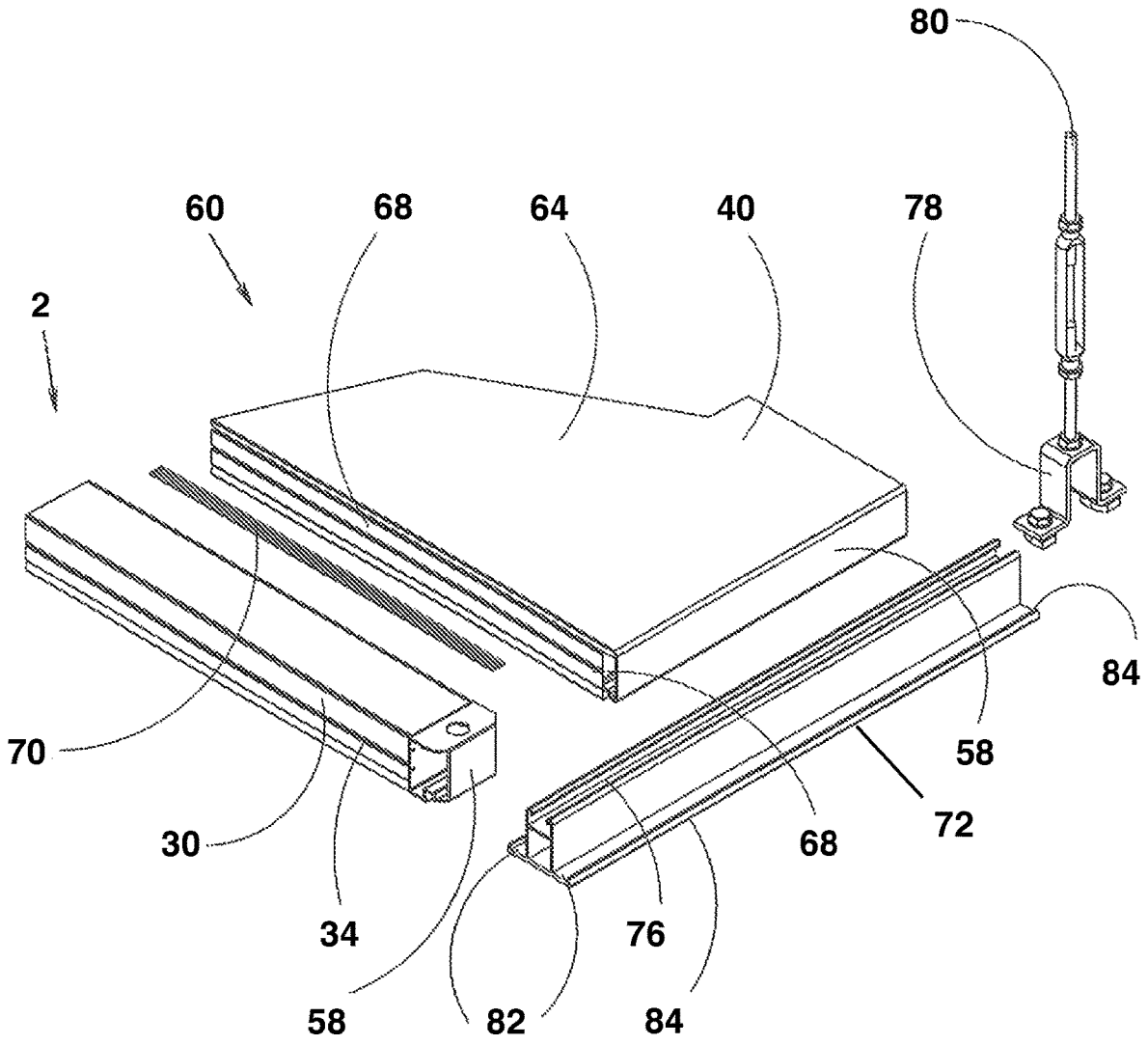
FIG. 10 is an exploded detail perspective view of the system of the Invention.

FIGS. 9 and 10 illustrate the construction and installation of the clean room ceiling 4 system, including the structural light fixture 2. FIG. 9 is a detail cutaway view of a ceiling 4. FIG. 10 is an exploded view of the ceiling 4. FIGS. 9 and 10 illustrate that the flush beams 72 are the principal structural component of the ceiling 4 and support the other components 60, including the structural light fixture 2. As shown by FIG. 9, each flush beam 72 includes a robust box section 74 and defines a T-channel 76. The T-channel 76 is configured to receive and retain a T-fastener 78. The T-fastener 78 is slidable within the T-channel 76. The T-fastener 78 is attached to a cable or rod 80 that is suspended from the structure of the building that houses the clean room or from an independent steel super-structure if required. The building supports the cable or rod 80, the cable or rod 80 supports the T-fastener 78, and the T-fastener 78 supports the flush beam 72. The flush beam 72 supports the ceiling components 60, including the structural light fixture 2. The ceiling components 60, including the structural light fixture 2 and the composite panel 62, may be interchangeably supported by opposing flush beams 72 as needed for a particular clean room design.

From FIGS. 9 and 10, the flush beam 72 defines a shelf 82. The shelf 82 extends from the opposing sides of the flush beam 72. Each shelf 82 defines a ridge 84. The shelf 82 and ridge 84 extend the length of the flush beam 72. The hook ends 58 that are attached to opposing ends 20, 22 of the structural light fixture 2 engage and are supported by the shelves 82 of two opposing flush beams 72. The ridges 84 align and retain the hook ends 58 and hence the structural light fixture 2 during installation, reducing the opportunity for mishap should a hook end 58 unintentionally become disengaged from its mating shelf 82.

Figure 11:
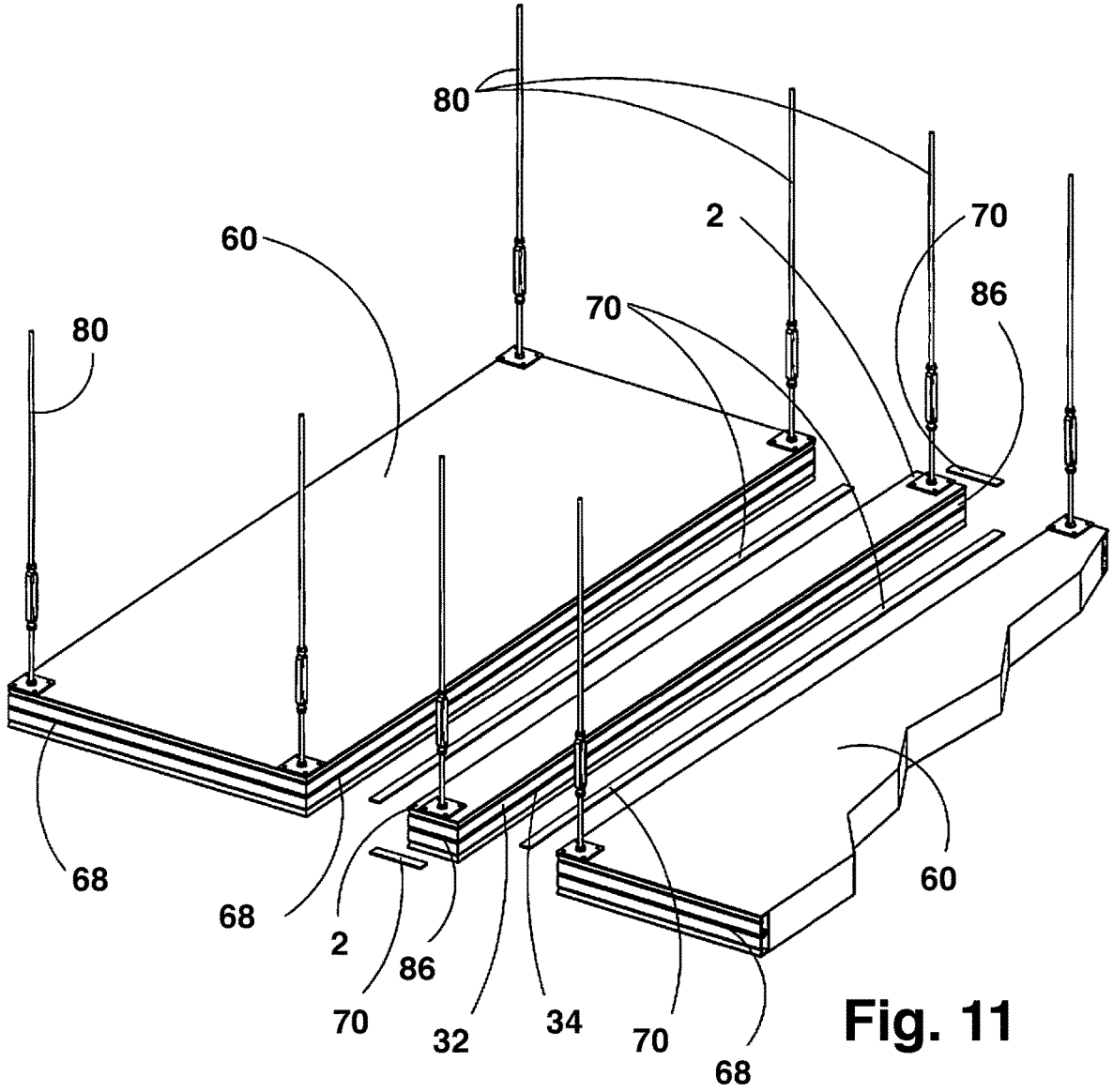
FIG. 11 is an exploded detail perspective view of a second system.

FIG. 11 is an exploded perspective view of an alternative to the ceiling 4 system described above. In the ceiling 4 of FIG. 11, flush beams 72 do not support the ceiling 4. For the alternative ceiling 4 construction of FIG. 11, the structural light fixture 2 described above dispenses with the hook ends 58 at the opposing ends 20, 22 of the structural light fixture 2. Instead, the structural light fixture 2 features end slots 86 at the opposing ends 20, 22 that correspond to component slots 68 in adjacent ceiling components 60. The structural light fixture 2 is attached to adjoining ceiling components 60 by splines 70 in end slots 86 on each of the opposing ends 20, 22 and by spline 70 in longitudinal slots 34 on opposing sides 30, 32 of the structural light fixture 2. Each longitudinal slot 34 and end slot 86 is disposed opposite a component slot 68 in an adjoining ceiling component 60. Each pair of adjoining components 2, 60 is connected by a spline 74 mating with the adjoining slots 34, 68, 86. Because of the lack of flush beams 72, the ceiling components 60 are suspended directly from the building structure, generally by rod or cables 80 attached to plates bolted to the ceiling components 2, 60. In all other respects, the structural light fixture 2 of the alternative ceiling 4 is the same as the structural light fixture 2 of the ceiling 4 utilizing flush beams 72 and as described above.

Figure 12:
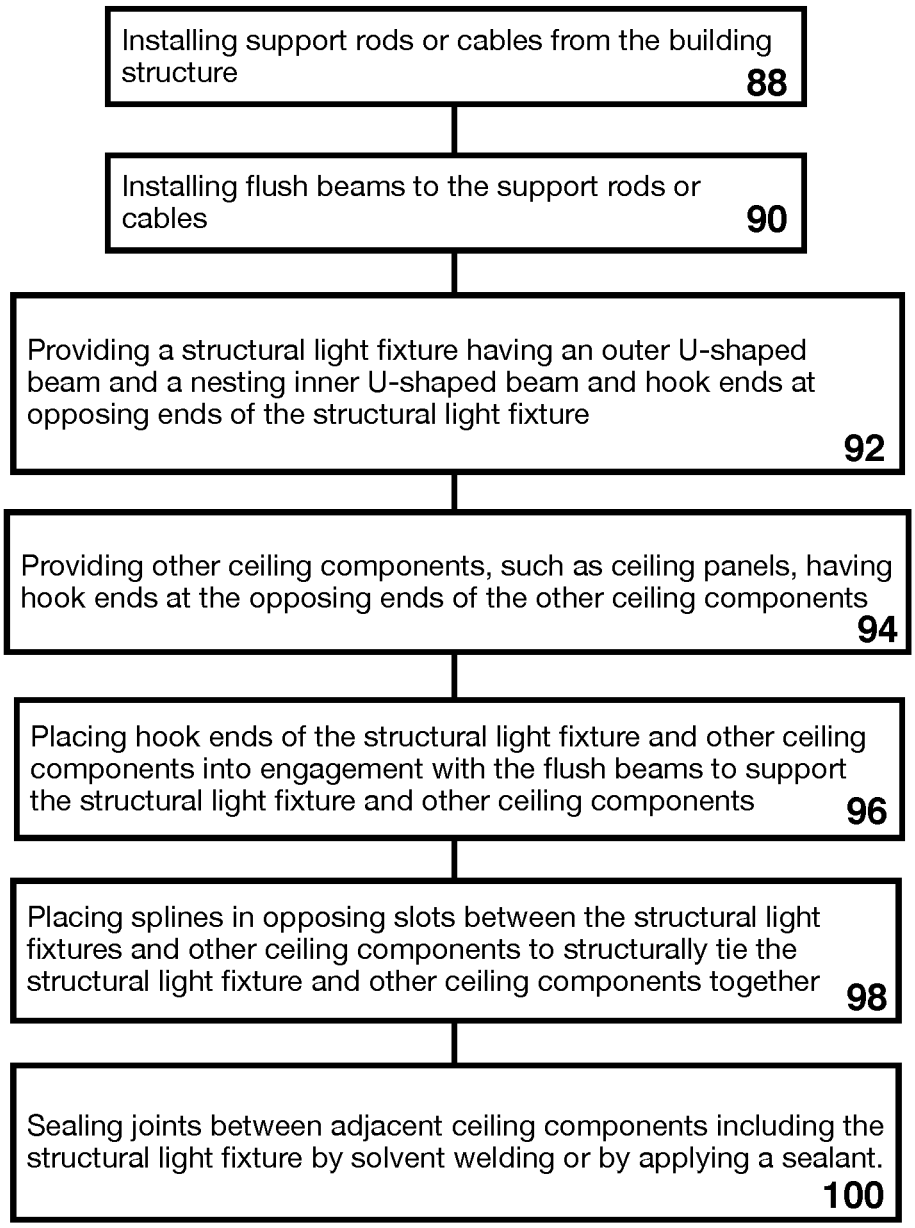
FIG. 12 is a flow chart of a method of installing the ceiling.

FIG. 12 illustrates the installation method of the Invention. To install the clean room ceiling 4 using the structural light fixture 2, an installer will install support rods or cables 80 to the building structure to support the clean room ceiling 4, shown by step 88 of FIG. 12. The installer will suspend opposing flush beams 72 from the rods or cables 80, shown by step 90 of FIG. 12. As described by steps 92 and 94 of FIG. 12, the installer will obtain the structural light fixture 2 and obtain other ceiling components 60, such as ceiling panels 62, other structural light fixtures 2, utility races or other structural beams. The structural light fixture 2 and other ceiling components 60 will have hook ends 58 as described above. The installer will engage the hook ends 58 of the structural light fixture 2 and the other ceiling components 60 with the opposing flush beams 72, as described by step 96 of FIG. 12. From step 98 of FIG. 12, the installer will place splines 70 in engagement with the longitudinal slots 34 of the structural light fixture 2 and the component slots 68 of the other ceiling components 60, structurally tying together the structural light fixture 2 and the other ceiling components 60. From step 100 of FIG. 12, after the structural light fixture 2 and ceiling components 60 are assembled as shown by steps 88 through 98, the installer will seal the joints between adjacent ceiling components 60 by either solvent welding or by application of a sealant.

In this document, elements of the same name and number on one figure or relating to an embodiment have the same or equivalent meaning when the element number is shown on another figure or in relation to another embodiment. The following are the numbered elements shown in the drawings and described in the specification.

A structural light fixture 2
a ceiling 4
a clean room 6
Underside of the structural light fixture 8
an outer U-shaped beam 10
an inner U-shaped beam 12
a lamp 14
a light 16 a lens 18
First end 20
Second end 22
an outer beam interior volume 24
an outer beam open side 26
An outer beam top side 28
Outer beam left side 30
Outer beam right side 32
Longitudinal slots 34
Clean room interior 36
Clean room exterior 38
Clean room ceiling top 40
an inner beam interior volume 42
an inner beam open side 44
Inner beam top side 46
Inner beam flanges 48
Outer beam surfaces 50
Fasteners 52
Power supply volume 54
Power supply 56
Hook end 58
Other component 60 of the ceiling
Composite panel 62
Skin 64
Core 66
Component slot 68
Spline 70
Flush beam 72
17
Box section 74
T-channel 76
T-fastener 78
Cable or rod 80
Shelf 82
Ridge 84
End slots 86
Installing support rods or cables 88
Installing flush beams 90
Providing the structural light fixture 92
Providing other ceiling components 94
Engaging hook ends with flush beams 96
Installing splines joining adjacent ceiling components 98
Sealing joints between adjacent ceiling components 100

What is claimed is:

1. A structural light fixture to be installed in a ceiling of a clean room, the structural light fixture comprising:

(a) an outer U-shaped beam, the outer U-shaped beam being elongated, the outer U-shaped beam being unitary, the outer U-shaped beam defining an outer beam interior volume, an outer beam open side, and at least one longitudinal slot on an exterior surface of the outer U-shaped beam;

(b) an inner U-shaped beam, the inner U-shaped beam being elongated, the inner U-shaped beam being unitary and defining an inner beam interior volume, an inner beam open side and an inner beam top side, the inner U-shaped beam being selectably attachable to the outer U-shaped beam, the inner beam top side nesting within the outer beam interior volume when the outer and inner U-shaped beams are attached;

(c) a lamp, the lamp being disposed within the inner beam interior volume, the lamp being configured to generate a light and to direct the light through the inner beam open side and the outer beam open side to the interior of the clean room when the structural light fixture is installed in the ceiling, and (d) at least one spline located in the longitudinal slot to secure the structural light fixture in the ceiling.

2. The structural light fixture of claim 1 wherein the outer and inner U-shaped beams having a configuration to transfer a structural load between the outer and inner U-shaped beams when the structural load is applied to the outer U-shaped beam or the inner U-shaped beam when the structural light fixture is installed in the ceiling of the clean room so that the outer and inner U-shaped beams are mutually reinforcing.

3. The structural light fixture of claim 2 wherein the configuration to transfer the structural load between the outer and inner U-shaped beams comprises: fasteners joining the outer and inner U-shaped beams.

4. The structural light fixture of claim 1, the structural light fixture further comprising: a lens, the lens releasably engaging the inner U-shaped beam, the lens covering the inner beam open side, the lens being configured to convey the light from the lamp through the inner beam open side, whereby a user may remove the lens to service the lamp when the structural light fixture is installed in the ceiling of the clean room and the user is inside the clean room.

5. The structural light fixture of claim 1 wherein the outer U-shaped beam has an outer beam left side, an outer beam right side and an outer beam top side, the outer beam top side joining the outer beam left and right sides, the outer beam top side being opposite to the outer beam open side, the outer beam left side, outer beam right side and outer beam top side in cooperation defining the outer beam interior volume.

6. The structural light fixture of claim 5 wherein the inner U-shaped beam has an inner beam left side and an inner beam right side, the inner beam top side being opposite to the inner beam open side, the inner beam left side, inner beam right side and inner beam top side in combination defining the inner beam interior volume, the inner beam top side being disposed within the outer beam interior volume when the inner U-shaped beam is nesting within the outer U-shaped beam.

7. The structural light fixture of claim 6 wherein the outer beam left side, outer beam right side, outer beam top side, and inner beam top side define a power supply interior volume within the outer beam interior volume when the inner U-shaped beam is nesting within the outer U-shaped beam, the structural light fixture further comprises: a power supply, the power supply being disposed within the power supply interior volume when the inner U-shaped beam is nesting within the outer U-shaped beam, the power supply being configured to illuminate the lamp.

8. The structural light fixture of claim 5 wherein the clean room has an interior and an exterior and the outer beam top side is exposed to the exterior of the clean room when the structural light fixture is installed in the clean room ceiling, and wherein the outer beam left side, the outer beam right side, and the outer beam top side are free of an opening communicating through the outer beam left side, outer beam right side or outer beam top side so that the outer beam left side, outer beam right side and outer beam top side are a barrier to movement between the interior and exterior of the clean room through the structural light fixture by a liquid, a gas, a particulate, a microorganism, or a disinfectant.

9. The structural light fixture of claim 8 wherein the power supply is attached to the inner U-shaped beam and wherein the inner U-shaped beam is selectably removable by a user from the outer U-shaped beam when the structural light fixture is installed in the clean room ceiling and the user is located on the interior of the clean room, whereby the user may service or replace the lamp and the power supply from the interior of the clean room in the absence of the opening through the structural light fixture to the exterior of the clean room.

10. The structural light fixture of claim 5 wherein the outer U-shaped beam has a configuration for mutual support of another ceiling component when the structural light fixture is installed in the ceiling of a clean room, the configuration comprises: the outer beam left and right sides each defines the longitudinal slot, the longitudinal slot corresponding in location to a component slot of another ceiling component when the structural light fixture and the other ceiling component are installed in the clean room ceiling, the longitudinal slot being configured to receive the spline that will also engage the component slot to mutually support the structural light fixture and the other ceiling component.

11. The structural light fixture of claim 10 wherein the outer beam having a first end and an opposing second end, the structural light fixture further comprising: a pair of hook ends, each hook end being attached to either the first end or the second end of the outer U-shaped beam, the hook ends having a configuration to support the structural light fixture when the structural light fixture is installed in the clean room ceiling.

12. The structural light fixture of claim 1 wherein the inner U-shaped beam covers the outer beam opening.

13. The structural light fixture of claim 1 wherein the outer U-shaped beam having a configuration for sealable engagement with the other clean room component to prevent a passage of a liquid, a gas, a contaminant or a disinfectant between the outer U-shaped beam and the other ceiling component when the structural light fixture is installed in the clean room ceiling, the configuration of the outer U-shaped beam for sealable engagement with the other ceiling component comprising: the outer beam left and right sides each defining a corner adjacent to the other ceiling component and a relief between the left or right side and the other ceiling component when the structural light fixture is installed in the clean room ceiling, the corner and the relief being configured to receive a caulk.

14. A method for maintaining a structural light fixture in a clean room ceiling of a clean room having a clean room interior, the method comprising the steps of:

(a) providing the structural light fixture installed in the clean room ceiling, the structural light fixture including an outer U-shaped beam, the outer U-shaped beam being elongated, the outer U-shaped beam defining an outer beam interior volume and an outer beam open side, the outer beam open side being oriented toward the interior of the clean room, the structural light fixture having an inner U-shaped beam, the inner U-shaped beam being elongated, the inner U-shaped beam defining an inner beam interior volume and an inner beam open side, the inner U-shaped beam being selectably attached to the outer U-shaped beam, the inner U-shaped beam nesting substantially within the outer beam interior volume, the structural light fixture having a lamp disposed within the inner beam interior volume, the lamp being configured to generate a light and to direct the light through the inner beam open side and the outer beam open side to the interior of the clean room;

(b) disengaging the inner U-shaped beam from the outer U-shaped beam and removing the inner U-shaped beam from the outer U-shaped beam by a user located on the interior of the clean room.

15. The method of claim 14 wherein a lens is disposed over the inner U-shaped beam open side, the method further comprising the following step prior to the step of disengaging the inner U-shaped beam from the outer U-shaped beam: removing the lens from the inner U-shaped beam open side.

16. The method of claim 14 wherein the step of disengaging the inner U-shaped beam from the outer U-shaped beam comprises: removing a plurality of fasteners attaching the inner U-shaped beam to the outer U-shaped beam.

17. The method of claim 14 wherein the clean room has an exterior and the outer U-shaped beam has an outer beam left side, an outer beam right side and outer beam top side, the outer beam left side, outer beam right side and outer beam top side defining the outer beam interior volume, the outer beam top side being exposed to the exterior of the clean room when the structural light fixture is installed in the clean room ceiling, the outer beam left side, the outer beam right side, and the outer beam top side being free of openings communicating through the outer beam left side, outer beam right side or outer beam top side, whereby the outer beam left side, outer beam right side and outer beam top side are a barrier to movement between the interior and exterior of the clean room through the structural light fixture.

18. A method of installing a ceiling for a clean room, the method comprising:

(a) installing support rods or cables so that the support rods or cables are suspended from a building structure;

(b) attaching opposing flush beams to the rods or cables;

(c) providing a structural light fixture, the structural light fixture including an outer U-shaped beam, the outer U-shaped beam being elongated and having two opposing ends, the outer U-shaped beam defining an outer beam interior volume and an outer beam open side, the outer beam open side being oriented toward the interior of the clean room when the clean room ceiling is installed, the structural light fixture having an inner U-shaped beam, the inner U-shaped beam being elongated, the inner U-shaped beam defining an inner beam interior volume and an inner beam open side, the inner U-shaped beam being selectably attached to the outer U-shaped beam, the inner U-shaped beam nesting substantially within the outer beam interior volume, the structural light fixture having a lamp disposed within the inner beam interior volume, the lamp being configured to generate a light and to direct the light through the inner beam open side and the outer beam open side to the interior of the clean room when the clean room ceiling is installed, the outer U-shaped beam having a hook end disposed at each of the opposing ends of the outer U-shaped beam;

(d) providing one or more other ceiling components, each of the other ceiling component having opposing component ends, each of the other ceiling components having the hook end disposed at each of the opposing component ends;

(e) engaging the hook ends of the structural light fixture and the other ceiling components with the opposing flush beams to support the structural light fixture and the other ceiling components between the opposing flush beams;

(f) placing a spline in engagement with a longitudinal slot defined by the outer U-shaped beam and with a component slot defined by a one of the other ceiling components so that the structural light fixture and the other ceiling component both engage the spline and are mutually supporting through the spline;

(g) sealing a joint between the structural light fixture and the other ceiling component.

19. The method of claim 18 wherein the clean room has an outside and the outer U-shaped beam has an outer beam left side, an outer beam right side and outer beam top side, the outer beam left side, outer beam right side and outer beam top side defining the outer beam interior volume, the outer beam top side being exposed to the outside exterior of the clean room when the structural light fixture is installed in the clean room ceiling, the outer beam left side, the outer beam right side, and the outer beam top side being free of openings communicating through the outer beam left side, outer beam right side or outer beam top side, whereby the outer beam left side, outer beam right side and outer beam top side are a barrier to movement between the interior and exterior of the clean room through the structural light fixture.

20. A clean room ceiling system, the system comprising:

(a) a pair of opposing flush beams having a configuration to be supported by a plurality of rods or cables;

(b) a structural light fixture, the structural light fixture including an outer U-shaped beam, the outer U-shaped beam being elongated and having two opposing ends, the outer U-shaped beam having a pair of hook ends disposed at the opposing ends of the outer U-shaped beam, the pair of hook ends being configured for engagement with the pair of opposing flush beams when the flush beams and the structural light fixture are installed in the clean room ceiling, the outer U-shaped beam defining an outer beam interior volume and an outer beam open side, the outer beam open side being oriented toward the interior of the clean room when the structural light fixture is installed in the clean room ceiling, the structural light fixture having an inner U-shaped beam, the inner U-shaped beam being elongated, the inner U-shaped beam defining an inner beam interior volume and an inner beam open side, the inner U-shaped beam being selectably attached to the outer U-shaped beam, the inner U-shaped beam nesting substantially within the outer beam interior volume, the structural light fixture having a lamp disposed within the inner beam interior volume, the lamp being configured to generate a light and to direct the light through the inner beam open side and the outer beam open side to the interior of the clean room when the structural light fixture is installed in the clean room ceiling;

(c) at least one other ceiling component, the outer U-shaped beam having a side, the side defining a longitudinal slot, the other ceiling component having a component side, the component side defining a component slot, the longitudinal slot and the component slot being immediately adjacent when the structural light fixture and the other ceiling component are installed in the clean room ceiling;

(d) at least one spline, the spline being configured to penetrate the longitudinal slot and the component slot to secure the structural light fixture and the other ceiling component together in a mutually supporting relationship when the structural light fixture and the other ceiling component are installed in the clean room ceiling.

21. The system of claim 20 wherein the clean room ceiling has an exterior and the outer U-shaped beam has an outer beam left side, an outer beam right side and outer beam top side, the outer beam left side, outer beam right side and outer beam top side defining the outer beam interior volume, the outer beam top side being exposed to the exterior of the clean room when the structural light fixture is installed in the clean room ceiling, the outer beam left side, the outer beam right side, and the outer beam top side being free of openings communicating through the outer beam left side, outer beam right side or outer beam top side, whereby the outer beam left side, outer beam right side and outer beam top side are a barrier to movement between the interior and outside of the clean room through the structural light fixture.

* * * * *